US005765233A

United States Patent [19]

Hayes

[11] Patent Number: 5,765,233

[45] Date of Patent: Jun. 16, 1998

[54] DISPOSABLE GOLF CLUB WIPING PATCH

[76] Inventor: Jeffrey A. Hayes, 1391 Peachwood Dr., Encinitas, Calif. 92024

[21] Appl. No.: 844,648

[22] Filed: Apr. 21, 1997

[51] Int. Cl.[6] ..... A41D 1/06

[52] U.S. Cl. ..... 2/227; 2/69; 15/208

[58] Field of Search ..... 2/227, 228, 79, 2/238, 51, 69, 1; 15/208, 209.1, 210.1, 227, 229.11

[56] References Cited

U.S. PATENT DOCUMENTS

| | | | |
|---|---|---|---|
| 1,293,700 | 2/1919 | Carlson | 2/231 |
| 2,651,071 | 9/1953 | Dyer et al. | 15/227 |
| 3,526,014 | 9/1970 | Edwards | 15/227 |
| 3,885,249 | 5/1975 | DeBrabander | 15/227 |
| 4,593,427 | 6/1986 | Ortolivo | 15/227 |
| 4,768,236 | 9/1988 | Klob | 2/227 |
| 4,771,478 | 9/1988 | Bisagno et al. | 2/227 |

*Primary Examiner*—Gloria M. Hale
*Attorney, Agent, or Firm*—Henri J. A. Charmasson; John D. Buchaca

[57] ABSTRACT

A disposable club head wiping patch is removably stuck to the lower portion of a golfer's trouser leg. The outer working surface of the patch includes a layer of scouring material preferably made of a piling of synthetic fiber segments hard enough to wipe off mud and grass debris that may have stuck to the club head.

7 Claims, 1 Drawing Sheet

DISPOSABLE GOLF CLUB WIPING PATCH

FIELD OF THE INVENTION

This invention relates to wearing apparel for golfers, and to scouring fabrics for cleaning club heads and similar implements.

BACKGROUND OF THE INVENTION

Golfers have the habit of wiping the face of their club head against their shoe, sock or the lower section of their leg after a swing or shot in order to remove mud and grass debris rather than using a rag or brush for that purpose. As a result, the trouser or other garment involved becomes quickly soiled.

Mud and grass debris that adhere to a club head during a swing can require extensive rubbing with a textile fabric before coming loose, particularly if the mud and debris are encrusted into a textured or engraved part of the club head.

SUMMARY OF THE INVENTION

The principal and secondary objects of this invention are to provide a convenient wiping surface on a lower section of a golfer's trousers that can be easily peeled off after a game to return the trouser to its original clean condition.

It is also an object of this invention to provide a wiping surface with some scouring power to remove dirt and grass debris that have encrusted textured areas of the golf club.

These and other valuable objects are achieved by a disposable patch of scouring material preferably made of a pile of synthetic fibre segments permanently mounted on a pliable support surface that has a tacky adhesive on the back for easy attachment and removal to or from a woven cloth fabric surface.

DESCRIPTION OF THE PREFERRED EMBODIMENT OF THE INVENTION

Figure 1:
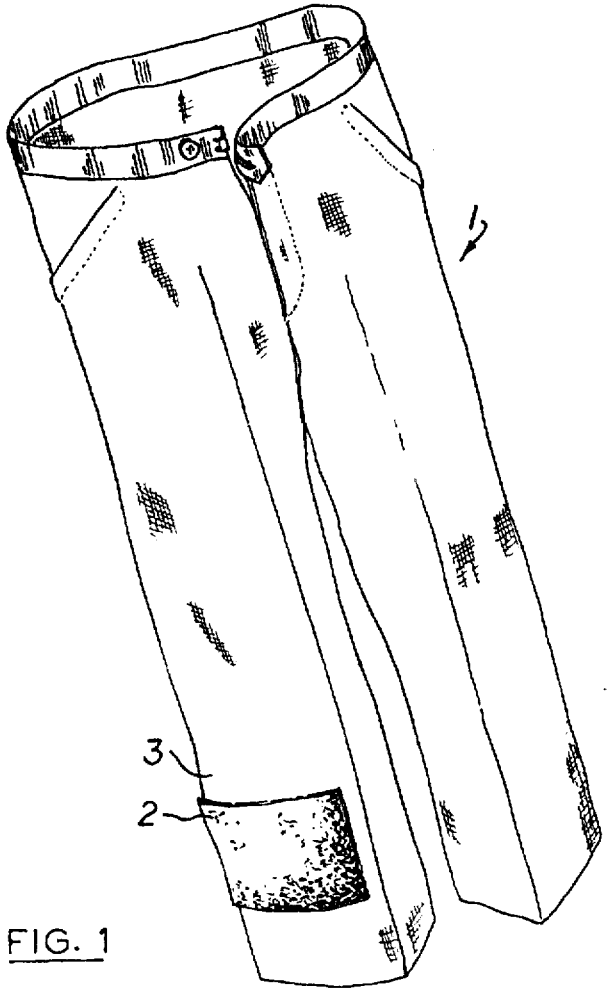
FIG. 1 is a perspective view of a pair of trousers bearing a wiping patch in accordance with the invention.
Figure 2:
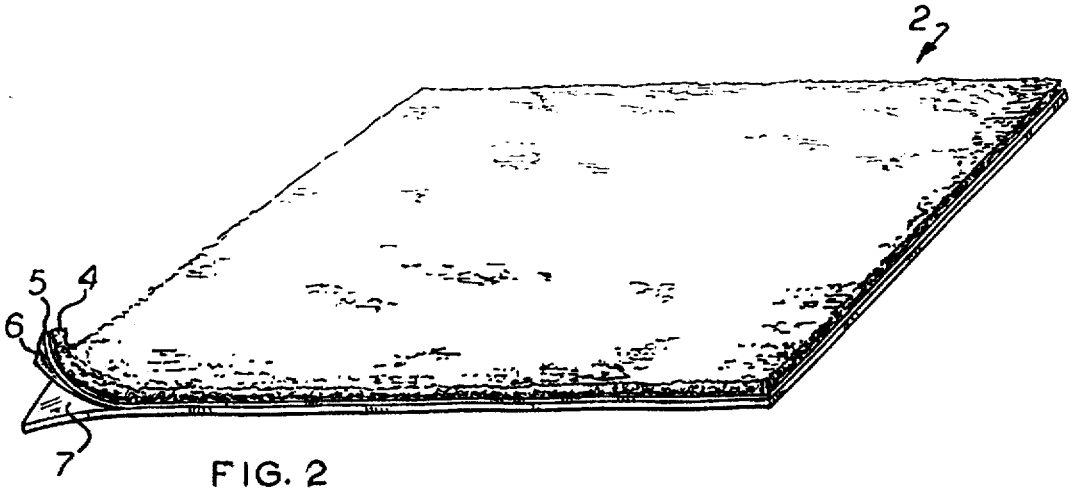
FIG. 2 is a perspective view of the patch prior to application to the outer surface of a garment.

Referring now to the drawing, there is shown in FIG. 1 a pair of trousers 1 to which a patch 2 according to the invention has been applied in the lower outer part 3 of the right leg. The patch is a rectangle of approximately 4×6 inches (10×15 centimeters). The outer working surface of the patch 4 is constituted by a layer of flexible scouring material. This material is preferably made of a pile of randomly distributed synthetic fabric segments such as nylon which had been agglutinated in slightly pressed or laminated together while in a viscous state according to techniques well-known in the art of packed rather than woven fibre fabrics. This loose fibre layer is bonded with a strong adhesive to a mounting sheet 5 of thick paper or plastic material. The back of the mounting sheet has been sprayed with a coat 6 of slow-curing adhesive that remains tacky for a long time such as an acrylic glue. A peelable, thin film 7 protects the coat 6 of adhesive until before the patch is applied to the garment 1. After the protective film has been removed, the patch can be applied directly to the fabric of the garment where it can remain for several hours or days. The entire patch can be removed at any time from the garment by peeling it off without leaving any trace of adhesive.

It should be noted that the patch could also be applied to the lower edge of a skirt, the side of a sock, boot or other type of high profile footwear.

Thus, a golfer wearing the patch can conveniently rub the heads of his clubs against it without fear of staining his clothing. At the end of the game, the patch can be peeled off and disposed of leaving the pants clean.

While the preferred embodiments of the invention have been described, modifications can be made and other embodiments may be devised without departing from the spirit of the invention and the scope of the appended claims.

What is claimed is:

1. A combination of a pair of trousers and a disposable wiping patch detachably secured thereupon, wherein said patch comprises:

a layer of flexible scouring material having a work face and an opposite mounting face;

a mounting sheet having an upper surface bonded to the mounting face of said layer of scouring material, and an opposite lower surface; and means for removably securing said lower surface to a lower leg portion of said pair of trousers, wherein said layer of scouring material comprises a pile of randomly distributed, agglutinated synthetic fibre segments:

said means for securing comprises a coat of high-tack adhesive spread over said lower surface for contact with said lower portion of the garment.

2. The combination of claim 1, wherein said layer of scouring material comprises a pile of randomly distributed, agglutinated synthetic fibre segments.

3. The combination of claim 2, wherein said means for securing comprises a coat of high-tack adhesive spread over said lower surface for contact with said lower portion of the garment.

4. A combination of a garment and a disposable wiping patch detachably secured thereupon, wherein said patch comprises:

a layer of flexible scouring material having a work face and an opposite mounting face;

a mounting sheet having an upper surface bonded to the mounting face of said layer of scouring material, and an opposite lower surface; and means for removably securing said lower surface to a lower portion of said garment;

wherein said layer of scouring material comprises a pile of randomly distributed, agglutinated synthetic fibre segments;

said means for securing comprises a coat of high-tack adhesive spread over said lower surface for contact with said lower portion of the garment; and said garment comprises a pair of trousers, and said lower portion comprises a leg section.

5. The combination of claim 1, wherein said mounting sheet is made of paper.

6. The combination of claim 4, wherein said layer of scouring material comprises a pile of randomly distributed, agglutinated synthetic fibre segments.

7. The combination of claim 6, wherein said means for securing comprises a coat of high-tack adhesive spread over said lower surface for contact with said lower portion of the garment.

* * * * *